US008859476B2

(12) United States Patent
Thomson

(10) Patent No.: US 8,859,476 B2
(45) Date of Patent: Oct. 14, 2014

(54) MULTI-PURPOSE, NON-CORROSIVE CLEANING COMPOSITIONS AND METHODS OF USE

(71) Applicants: Vitech International, Inc., Edgerton, WI (US); Win Chemicals Ltd, Burlington (CA)

(72) Inventor: Rod Thomson, Burlington (CA)

(73) Assignees: Vitech International, Inc., Edgerton, WI (US); Win Chemicals Ltd, Burlington, Ontario (CA)

( * ) Notice: Subject to any disclaimer, the term of this patent is extended or adjusted under 35 U.S.C. 154(b) by 0 days.

(21) Appl. No.: 13/901,911

(22) Filed: May 24, 2013

(65) Prior Publication Data

US 2013/0260649 A1 Oct. 3, 2013

Related U.S. Application Data

(62) Division of application No. 11/637,397, filed on Dec. 12, 2006, now Pat. No. 8,450,257.

(60) Provisional application No. 60/749,448, filed on Dec. 12, 2005.

(51) Int. Cl.

| | |
|---|---|
| ***C11D 3/34*** | (2006.01) |
| ***C11D 3/00*** | (2006.01) |
| ***C11D 3/32*** | (2006.01) |
| ***C11D 7/32*** | (2006.01) |
| ***C11D 7/34*** | (2006.01) |

(52) U.S. Cl.

CPC ..... *C11D 3/3454* (2013.01); *C11D 7/3272* (2013.01); *C11D 3/0073* (2013.01); *C11D 7/34* (2013.01); *C11D 3/323* (2013.01); *C11D 3/3409* (2013.01)

USPC ..... 510/101; 510/109; 510/174; 510/496; 451/28

(58) Field of Classification Search

USPC ..... 510/101, 109, 274, 496; 451/28

See application file for complete search history.

(56) References Cited

U.S. PATENT DOCUMENTS

| | | | | |
|---|---|---|---|---|
| 3,320,173 | A | 5/1967 | Minor | |
| 3,591,416 | A * | 7/1971 | Johnson | 134/2 |
| 4,239,696 | A | 12/1980 | Schreyer et al. | |
| 4,643,813 | A | 2/1987 | Sato et al. | |
| 4,673,522 | A | 6/1987 | Young | |
| 4,747,975 | A | 5/1988 | Ritter | |
| 4,844,744 | A * | 7/1989 | Leiter et al. | 134/40 |
| 4,938,846 | A | 7/1990 | Comstock et al. | |
| 5,234,466 | A | 8/1993 | Sargent et al. | |
| 5,492,629 | A | 2/1996 | Ludwig et al. | |
| 5,616,151 | A * | 4/1997 | Sargent et al. | 8/636 |
| 5,672,279 | A | 9/1997 | Sargent et al. | |
| 5,672,578 | A * | 9/1997 | Carrie et al. | 510/245 |
| 5,698,513 | A | 12/1997 | Schulz et al. | |
| 5,733,463 | A | 3/1998 | Sargent et al. | |
| 5,750,733 | A | 5/1998 | Vermeer et al. | |
| 5,912,219 | A * | 6/1999 | Carrie et al. | 510/238 |
| 5,919,375 | A | 7/1999 | Sargent et al. | |
| 6,333,005 | B1 | 12/2001 | Nguyen | |
| 6,340,660 | B1 | 1/2002 | Gastgaber | |
| 6,355,214 | B1 | 3/2002 | Fader et al. | |
| 6,362,148 | B1 | 3/2002 | Durbut et al. | |
| 6,365,101 | B1 | 4/2002 | Nguyen et al. | |
| 6,495,714 | B1 | 12/2002 | Halbritter et al. | |
| 6,593,287 | B1 * | 7/2003 | Jordan et al. | 510/475 |
| 6,632,291 | B2 | 10/2003 | Rabon et al. | |
| 6,689,223 | B1 * | 2/2004 | Meine et al. | 134/2 |
| 6,844,309 | B1 | 1/2005 | Sivik et al. | |
| 6,927,305 | B2 | 8/2005 | Choudary et al. | |
| 7,029,553 | B1 | 4/2006 | Williams et al. | |
| 2001/0045393 | A1 | 11/2001 | Sargent et al. | |
| 2003/0038085 | A1 | 2/2003 | Sargent et al. | |
| 2005/0152991 | A1 | 7/2005 | Man et al. | |
| 2007/0000523 | A1 * | 1/2007 | Kim et al. | 134/25.4 |
| 2007/0066508 | A1 | 3/2007 | Chen et al. | |
| 2013/0260649 | A1 * | 10/2013 | Thomson | 451/28 |

FOREIGN PATENT DOCUMENTS

| | | |
|---|---|---|
| CA | 2173438 | 12/1999 |
| CA | 2189345 | 7/2000 |
| CA | 2499592 | 9/2005 |
| HU | 37811 | 2/1986 |
| HU | 195241 | 4/1988 |
| WO | 9534511 | 12/1995 |
| WO | 9618717 | 6/1996 |
| WO | 2006029823 | 6/2006 |

* cited by examiner

*Primary Examiner* — Nicole M Buie-Hatcher

*Assistant Examiner* — M. Reza Asdjodi

(74) *Attorney, Agent, or Firm* — Reinhart Boerner Van Deuren s.c.

(57) ABSTRACT

Compositions comprising an alkanesulfonic acid and an organic nitrogenous base, and related methods of use.

18 Claims, No Drawings

MULTI-PURPOSE, NON-CORROSIVE CLEANING COMPOSITIONS AND METHODS OF USE

This application is a divisional of and claims priority benefit from application Ser. No. 11/637,397 filed Dec. 12, 2006 and issued as U.S. Pat. No. 8,450,257 on May 28, 2013, which claimed priority from application Ser. No. 60/749,448 filed Dec. 12, 2005—each of which is incorporated herein by reference in its entirety.

BACKGROUND OF THE INVENTION

Field of the Invention

The present invention relates generally to multipurpose, cleaning compositions, and more particularly to, multipurpose, noncorrosive acid cleaning compositions, methods of preparation and use thereof in the cleaning of surfaces.

Acids perform a wide variety of unique cleaning functions in both industrial and domestic settings. This includes removal of metal based scales such as calcium carbonate or rust from hard surfaces. Some of these applications include, for example, bathroom cleaning for removal of hard water scale and soap scum, descaling of kettles and coffee makers and removing from boilers and cooling towers. The use of acids extends to the cleaning of vehicles as an aid to removal of road film and other complex organic and/or inorganic matrices.

Typically, in order to achieve effective results in a timely fashion in any of these applications, strong mineral acids such as hydrochloric or sulfuric acid are used, sometimes in conjunction with milder, weak acids such as citric or glycolic acid. The challenge for the formulating chemist is to find a high performing product that is both safe and environmentally responsible, with biodegradation to carbon dioxide or minerals being the final fate after entry into the general environment.

In addition, concentrated cleaners containing these strong mineral acids are dangerous to use, often producing fumes that cause choking or more complicated or serious respiratory problems. Further, contact with skin can result in irritation of the skin to, in some cases, severe burning—depending upon the composition of the cleaner. The mechanism of the burns can involve acid catalysed hydrolysis of tissue (most common) and/or oxidative decomposition, depending upon the acid (e.g. nitric).

As such, these complicating factors require the material to be classified as corrosive, which impacts the labeling of the product, the transportation mode available for the product, and therefore, cost. The increase in cost associated with the production and shipping of such conventionally used corrosive cleaning materials can be quite significant in terms of marine and air shipping—resulting in either total restriction from air or marine shipping, or resulting in very high cost and requiring specialized shipping containers.

Furthermore, most strong acids are very aggressive to aluminum, and therefore, render them inappropriate for use in cleaning aluminum surfaces. The reaction that takes place is an oxidation of the aluminum with concurrent reduction of the acid protons to hydrogen gas. This naturally creates potential fire and explosion hazards in use, especially in poorly ventilated situations. Another result of the oxidation process is the creation of dark stains, which are unsightly and must be laboriously polished off, or chemically removed with the extremely dangerous hydrofluoric acid.

This same oxidative effect occurs in the treatment of mild steel with certain acids, such as hydrochloric acid. Hydrogen gas evolves in this case as well. Unfortunately, this type of corrosion is often associated with indirect contact caused by acid fumes. Ultimately, it can affect structural integrity of steel (or aluminum) components.

A number of technologies are available that are used to control some of these phenomena. Amine based acid inhibitors are often used with mineral acids such as hydrochloric, sulfuric or sulfamic acid to depress the rate of dissolution (via oxidation) of mild steel. These inhibitors are widely used because of this positive feature. Similarly, acetylenic alcohols are used to retard the rate of corrosion of aluminum or galvanized metals. Although reasonably effective, these materials (especially the latter) are quite odorous and have not insignificant toxicity profiles, limiting their usefulness to only a few industrial applications.

Although inhibitors can aid in corrosion prevention of metals, they certainly do nothing to aid in personal safety, and skin irritation/corrosion is still an issue. Thus, in order to minimize safety and environmental problems associated with the use of such acidic cleaning agents, reaction of strong mineral acids, such as hydrochloric acid, with very weak bases such as urea, can produce salts with extremely low pKa values, such that the salt still behaves as a strong acid. Accordingly, the salt formation creates a non-fuming product, and when a proper mole ratio is used, corrosivity of the skin can be greatly reduced. Urea hydrochloride, as more fully described in U.S. Pat. No. 5,672,279, is one such example. This compound however, although a safe and effective acid for descaling, suffers due to its aggressiveness to aluminum and staining of metals such as stainless steel or brass. This severely limits its use in domestic applications significantly.

In summary, acids perform a multiplicity of functions as cleaners and are a practical requirement for use in the home and the workplace. However, the dangers and potential problems with corrosion of metals and/or the surfaces to be cleaned are difficulties that must be effectively managed, as there are so few viable, safe options. There is currently no single acidic raw material that is both safe on metals and the skin.

Accordingly, there is an ongoing effort in the art to develop an acid for use as a raw material useful over a wide range of acid cleaning applications. In particular, metal salt solubility (especially of carbonates) of the cleaning composition can be a critical attribute in certain applications. Further, the acid composition should be essentially safe from both health and safety as well as metal corrosion/staining perspectives. In addition, such compositions should have a good environmental profile and be readily biodegradable after entry into the environment. Finally, a low odor profile would also be desirable to ensure widespread application of the cleaning product.

Thus, without limitation, one consideration is the requirement of strong acidity (high rate of proton dissociation). For example, an acid with a low pKa will work much quicker in any cleaning application than a weak acid. This eliminates the bulk of organic acids with carboxylate functionality (citric, glycolic, etc). While mineral acids fit this key criterion, many suffer from environmental or performance issues. Phosphoric acid is a phosphorus source and an obvious environmental problem. Sulfuric acid forms sparingly soluble salts with calcium and is therefore unsuitable as a universal cleaner. Nitric acid is an oxidizer, severely limiting its use. Halide based acids are a possibility, however, hydrofluoric acid is not a strong acid and subject to severe health and safety concerns. Hydroiodic acid suffers from issues of both cost and oxidation of iodide to iodine, which is an undesirable staining agent. Hydrochloric acid is the only real viable choice, but again has strong aggression to aluminum and also is highly corrosive/staining to metals such as stainless steel.

SUMMARY OF THE INVENTION

In light of the foregoing, it is an object of the present invention to provide various multipurpose, noncorrosive acid cleaning compositions and/or methods for their preparation and/or use, thereby overcoming various deficiencies and shortcomings of the prior art, including those outlined above. It will be understood by those skilled in the art that one or more aspects of this invention can meet certain objectives, while one or more other aspects can meet certain other objectives. Each objective may not apply comparably, in all its respects, to every aspect of this invention. As such, the following objects can be viewed in the alternative with respect to any one aspect of this invention.

It is an objective of the present invention to provide one or more cleaning compositions and/or systems comprising an alkanesulfonic acid in combination with an organic nitrogenous base component and, optionally, an acid inhibitor, the composition or system being noncorrosive and nonstaining to a variety of surfaces, in particular, aluminum, brass and/or steel surfaces.

It is a related objective of the present invention to provide an alkanesulfonic acid-based, highly effective cleaning composition that is nonirritating and/or noncorrosive to the skin, environmentally safe, readily biodegradable, and therefore, less expensive to transport and use over conventional acid cleaning products.

It is, accordingly, an objective of the present invention to remove scale, film, rust or other unwanted build-up or residue, such as water-insoluble metal salts (e.g, carbonates), from a surface and/or a substrate using an alkanesulfonic acid composition.

It is, also, an objective of the present invention, in conjunction with one or more of the preceding objectives, to provide one or more of the inventive compositions formulated and/or as provided with an appropriate delivery system, as would be understood in the art, to achieve desired performance parameters.

Other objects, features, benefits and advantages of the present invention will be apparent in this summary and descriptions of preferred embodiments, and will be readily apparent to those skilled in the art having the knowledge and experience in the area of cleaning compositions for a particular end-use cleaning application (e.g. industrial versus household cleaning applications and/or type of surface to be cleaned, metal, ceramic, fiberglass, plastic, glass, etc.). Such objects, features, benefits and advantages will be apparent from the above as taken in conjunction with the accompanying examples, data and all reasonable inferences to be drawn therefrom.

In light of the foregoing, the present invention, in part, can be directed to a cleaning composition comprising an alkanesulfonic acid component and an organic nitrogenous base component. The amount or compositional concentration of alkanesulfonic acid can vary depending upon desired performance properties or end use application, with various concentrations available, as illustrated herein.

The compositions of the present invention can be used as aqueous solutions or dispersions in a ready-to-use form. Alternatively, depending on the nature of use and application, the compositions can be in form of a concentrate containing a high proportion of an alkanesulfonic acid-base system, the concentrate being diluted with water before use. As demonstrated through use of certain embodiments, such concentrates can withstand storage for prolonged periods and after such storage be capable of dilution with water in order to form aqueous preparations which can remain homogeneous or otherwise dispersed for a sufficient time to enable them to be applied by conventional methods. After dilution to form aqueous preparations, such preparations may contain varying amounts of the active acid-based cleaning composition, depending upon the intended purpose or end-use application.

The compositions of the present invention can be applied, formulated or unformulated, directly to the surface to be treated, or they can be sprayed on, dusted on or applied as a solid, cream, paste or an emulsion, such embodiments as can be prepared using formulation techniques well-known to those skilled in the art. For instance, compositions to be used as sprays may be in the form of aerosols wherein the formulation is held in a container under pressure of a propellant, e.g. fluorotrichloromethane or dichlorodifluoromethane.

In certain embodiments, the alkanesulfonic acid component can be a methanesulfonic acid (MSA). Methanesulfonic acids (MSA) provide excellent solubility for a wide range of metal salts. Methanesulfonic acid has found wide acceptance in electrochemical processes due to this fact and its high conductance. It is completely passive to aluminum making it somewhat unique in the acid world. It does have an excellent environmental profile (ready biodegradability) and is very low odor. However, it is both corrosive to skin and mild steel and therefore has seen very limited use in cleaning applications. Notwithstanding such concerns, an alkanesulfonic acid component, and in particular, methanesulfonic acid can be used in the inventive cleaning compositions of the present invention without the corrosivity issues conventionally associated with use of methanesulfonic acid alone.

In addition, one or more higher alkylated (e.g., $C_2$ and/or $C_3$ to . . . about $C_6$ and/or to . . . about $C_{10}$ alkyl moiety or greater) sulfonic acids may be used in combination with MSA (i.e., $C_1$), or alternatively, in place of MSA, depending on the type of end use application and compositional requirements for the particular cleaning system. As such, an alkanesulfonic acid component of this invention can comprise a saturated or unsaturated, cyclic, straight or branched and/or substituted or unsubstituted alkanesulfonic acid and/or combinations thereof, such as one or more such alkanesulfonic acids, including, but not limited to, ethane-, propane-, butane- and/or hexanesulfonic acid.

The alkanesulfonic acid can be synthesized using any method known to those skilled in the art. For example, the alkanesulfonic acid can be synthesized via oxidation of an alkyl mercaptan or dialkyl disulfide using one or more various oxidizing agents, such as chlorine, hydrogen peroxide, dimethyl sulfoxide or hydroiodic acid, or alternatively utilize electrochemical oxidation, as will be well known to those skilled in the art. Various other methods of alkanesulfonic acid production include, but are not limited to, those as more fully described in U.S. Pat. No. 4,643,813 to Sato et al., U.S. Pat. No. 6,495,714 to Halbritter et al., U.S. Pat. No. 6,927,305 to Choudary et al., the entirety of each are incorporated herein by reference. Choice of alkanesulfonic acid and method of production can be made by desired performance properties of the alkanesulfonic acid (required cleaning activity of the composition, type of surface to be contacted, environment of application, etc.), and can be reflected, at least in part, by the length of the alkyl group for a particular alkanesulfonic acid component.

In certain embodiments, compositions of this invention can comprise an alkanesulfonic acid to nitrogenous base mole ratio ranging from about 0.7 to about 1.4. In certain other embodiments such compositions can be characterized as providing a weight ratio of alkanesulfonic acid to nitrogenous base ranging from about 1.5 to about 2.1. Alternatively, certain embodiments of the present invention can be characterized as comprising an organic nitrogenous base component, in an about 0.5 to about 5.0 molar ratio with respect to the acid concentration. In certain other embodiments, comprising methanesulfonic acid, such a component can be about 0.5 to about 75 weight percent of such a composition; and where such a composition comprises urea, such a base component can comprise about 0.5 to about 35 weight percent of the composition. Regardless, the relative amounts and/or concentrations of alkanesulfonic acid component and base component in the compositions of the present invention can vary widely and independently, depending on the desired function of the composition and/or the required cleaning activity, as demonstrated in the examples that follow. As such, the weight ratios and/or concentrations utilized are preferably selected to achieve a composition and/or system that is nonstaining/noncorrosive to the particular surface to be treated, or as dictated by a specific end use application, while also being substantially noncorrosive and/or nonirritating to the skin, nonfuming and environmentally safe.

Consistent with the broader aspects of the present invention, one or more substantially equivalent weak bases, or compounds imparting basic functionality may be used in place of or in combination with urea. Examples of other such base components include, but are not limited to, biuret (urea dimer) and other soluble urea compounds, alkyl urea derivatives, alkanolamines, including triethanolamine, diethanolamine, monoethanolamine and $HO—[(alkyl)O]_x—CH_2)_yNH_2$, including $HO—[(CH_2)_xO]—CH_2)_xNH_2$; wherein the alkyl group can vary within the moiety, wherein x is 1-about 8 (which can vary within the moiety) and y is an integer of 1 to about 40; alkylamines, dialkylamines, trialkylamines, alkyltetramines, polymers with amino or (alkyl or aryl)amino substituent groups, polymers with nitrogen-containing heterocyclic groups, acrylamide, polymers and copolymers of acrylamide, vinyl pyrollidone, polyvinyl pyrollidone, copolymers of vinyl pyrollidone, methacrylamide, polymethacrylamide, copolymers of acrylamide, ammonia and combinations thereof. Such bases may also include one or more of those described in U.S. Pat. Nos. 5,234,466, 5,616,151 and/or 5,672,279 to Sargent et al., each of which is incorporated herein by reference in its entirety.

In certain other embodiments, the cleaning compositions of the present invention can comprise one or more acid and/or corrosion inhibitor components. An corrosion inhibitor employed in the present invention can be any one or more corrosion inhibitors known to those skilled in the art and/or can be chosen on the basis of several factors including, but not limited to, the type of surface to be treated (metals, such as, aluminum, steel, iron, brass, copper, ceramics, plastics, glass etc.), the particular alkanesulfonic acid(s)/base components and concentrations thereof included in the system, system pH, the inhibitor efficiency, inhibitor solubility characteristics, desired length of exposure of the system to the surface, environmental factors, etc. Accordingly, the corrosion inhibitor can be any acid inhibitor known to one skilled in the art, including but not limited to, sulfonate, carboxylate, amine, amide and borated-based inhibitor compounds. In certain embodiments of the present invention, the acid inhibitor can be an amine based inhibitor, optionally in concentrations from about 0.05 to about 0.3% weight percent. (Such amine based inhibitor compositions can be of the type sold under the registered trademark Armohib® by Akzo Nobel or its licensees).

Likewise, such compositions can optionally comprise one or more nonionic, anionic, cationic or amphoteric surfactants or a mixture thereof to improve both performance and economy. The type of surfactant selected can vary, for example, depending on the nature of the particular conditions of use (i.e. type of residue to be removed or type of surface), the particular system components (specifically, the use of an MSA component or a higher order alkanesulfonic acid component) and/or the nature of the solvent (aqueous versus a less polar solvent such as an alcohol or other organic solvent). In certain embodiments of the present invention, a composition can include a nonionic surfactant, such as that available under the tradename WinSurf/Videt Q3, which demonstrates rapid wetting due to the excellent, associated dynamic surface tension profile (available from Win Chemicals Ltd. and Vitech International, Inc.).

Depending on the type of end-use application, compositions of the present invention may also comprise any other required components including, but not limited to, solid or liquid carriers or propellants to facilitate application, surfactants, thickeners, thixotropic agents, penetrating agents, stabilizers, brighteners, as will be well known to those skilled in the art.

Accordingly, in part, the present invention can comprise a multipurpose, noncorrosive cleaning system comprising a combination of an alkanesulfonic acid component, preferably, methanesulfonic acid, with a base component and a corrosion inhibitor component applied to a surface. Such embodiments can provide a high activity product that can uniquely and surprisingly possess one or more of the following combined features: (1) no skin sensitivity/corrosivity after four hour exposure, non irritant; (2) non-corrosive to aluminum as per standard Department of Transportation (DOT) test methods; (3) non-corrosive to mild steel as per standard Department of Transportation (DOT) test methods; (4) ready biodegradability; (5) extremely low odor profile; (6) non fuming; and (7) non staining with respect to stainless steel and brass.

In view of the first three features and unlike conventionally used acid cleaning compositions, the compositions/systems of the present invention can be shipped non-regulated in North America and Europe. Specifically, the present invention provides an effective, high activity acid cleaning system that can be readily transported in air or marine situations, which otherwise had not been possible. The inventive compositions, including those embodiments described in conjunction with optional components of the type discussed herein, are commercially-available from Vitech International, Inc. of Janesville, Wis., USA and Win Chemicals Ltd. of Burlington, Ontario, Canada.

This invention can also be directed to a method of treating or cleaning a surface (e.g., without limitation, a hard commercial or household surface) with an alkanesulfonic acid-based composition, to remove surface contaminants. Such a method can comprise providing one or more of the compositions of this invention, including but not limited to those specifically described herein; and contacting a surface or a substrate with such a composition. The compositions of this invention and as can be used in such a method can comprise any one or more of the alkanesulfonic acid components discussed herein in combination with an organic nitrogenous base component, as can be considered in the context of the corresponding acid/base salt. Alternatively, such a composition can be prepared at or about the time of surface treatment, by mixing such an alkanesulfonic acid component and a nitrogenous base component. The surface may be contacted with the composition for a given period of time and/or to effect a specific level of cleaning, descaling and/or brightening activity on the surface. Accordingly, the invention includes, in part, a composite cleaning system comprising a substrate having at least a portion containing an alkanesulfonic acid composition disposed thereon, wherein cleaning activity is effected on the portion of the substrate coated with the composition. The types of substrates encompassed within the composite cleaning system of the present invention can include, but are not limited to, metals, such as aluminum, steel or brass, ceramics, tile, stone, brick, glass, fiberglass, wood and/or composites thereof.

An alkanesulfonic acid cleaning composition may be any one or more of those described herein, and can be disposed and/or applied to one or more surfaces of the substrate using any means known to those skilled in the art. In particular, the substrate can be coated with the composition such that the composition mechanically or otherwise interacts with and/or adheres to the substrate. More specifically, the alkanesulfonic acid cleaning composition can be formulated, consistent with the teachings of the invention, to ensure sufficient adhesion of the composition to the substrate during use of the system. Such formulations can depend on the substrate chemical composition and surface properties, the specific acid component and base component used in the cleaning composition and/or the wettability/surface tension between the substrate and the cleaning composition.

Accordingly, the present invention can be directed to a method of using an alkanesulfonic acid composition to treat a substrate for accumulation of contaminants (e.g., without limitation calcium and magnesium carbonates and other salts, etc.) of the sort described herein. Such a method can comprise providing an effective amount of a composition comprising an alkanesulfonic acid component and a base component; and contacting and/or treating the substrate with such a composition. The method can comprise contacting the substrate with such a composition for a length of time and/or at a compositional concentration at least partially sufficient to remove at least one contaminant from the substrate surface and/or effect a desired level of cleaning or treatment activity on the surface. As demonstrated below, such contact with a metal or an otherwise affected surface can be substantially absent surface corrosion.

The cleaning compositions for use in the present methods can be any one or more of those described herein—and can be used to clean, remove contaminants, build-up and/or residue from the substrate. The specific components of the cleaning composition can be selected as a matter of design choice, and therefore, can depend on the type of build-up (metal salts, proteinaceous materials, dust, including silicious materials, carbonaceous, both organic and inorganic materials, minerals, etc.), stains, rust, lime, soap scum and/or the type of substrate to be treated.

Such a method can further comprise providing at least one corrosion inhibitor component in an amount effective to provide a sufficient level of acid inhibiting activity for the type of substrate to be treated. The method can also include adding a surfactant component the system, depending on the type of alkanesulfonic acid component utilizes, the type of build-up and/or type of surface to be treated.

Consistent with the broader aspects of the present invention, the invention may also comprise a kit for treating a hard surface, such a kit comprising a first enclosure containing an effective amount of an alkanesulfonic acid component, and a second enclosure containing an amount of base component at least partially sufficient to form a salt of the alkanesulfonic acid component when the base component is contacted with the alkanesulfonic acid component. At least one of the first and the second enclosures can include a corrosion inhibitor, and/or optionally, at least one surfactant component. Such a kit can be provided in an anhydrous form; however, at least one of the first and the second enclosure can include water or another appropriate solvent, or fluid medium.

EXAMPLES OF THE INVENTION

The following, non-limiting examples and data illustrate various aspects and features relating to the compositions and/or methods of the present invention, including the formulation of representative compositions for the applications shown. In comparison with the prior art, the present compositions and methods provide results and data which are surprising, unexpected and contrary thereto. While the utility of this invention is illustrated through the use of several compositions and formulations, which can be used therewith, it will be understood by those skilled in the art that comparable results are obtainable with various other compositions, incorporating other alkanesulfonic acids, transition metal salts and base components, as are commensurate with the scope of this invention.

Example 1A

A wide range of formulations can be prepared in accordance with this invention. Using procedures analogous to those described in the examples that follow, the present methods are effected, in accordance with this invention, using compositions comprising various combinations of one or more of the following non-limiting alkanesulfonic acid (A) and one or more base (B) components.

TABLE 1

| Cleaning Compositions | |
|---|---|
| Alkanesulfonic acid component (A) | methanesulfonic acid, any saturated straight or branched alkanesulfonic acid and/or combinations thereof, and can specifically include one or more higher alkanesulfonic acids, including, but not limited to, ethane-, propane-, butane- and/or hexanesulfonic acid. |
| Base Component (B) | Urea, biuret (urea dimer) and other soluble urea compounds, alkyl urea derivatives, alkanolamines, including triethanolamine, diethanolamine, monoethanolamine and HO—[alkyl)O]$_x$—CH$_2$)$_y$NH$_2$, including HO—[(CH$_2$)$_x$O]—CH$_2$)$_x$NH$_2$; wherein the alkyl group can vary within the moiety, wherein x is 1- about 8 (which can vary within the moiety) and y is an integer of 1 to about 40; alkylamines, dialkylamines, trialkylamines, alkyltetramines, polymers with amino or (alkyl or aryl)amino substituent groups, polymers with nitrogen-containing heterocyclic groups, acrylamide, polymers and copolymers of acrylamide, vinyl pyrollidone, polyvinyl pyrollidone, copolymers of vinyl pyrollidone, methacrylamide, polymethacrylamide, copolymers of acrylamide, ammonia and combinations thereof. |

Such cleaning combinations can be prepared, as would be understood by those skilled in the art—without undue experimentation—as provided herein or using straight forward modifications of known techniques, over a wide range of concentrations of acid component and base component. Such components are preferably provided in amounts sufficient to provide a salt of the alkanesulfonic acid component. Likewise, cleaning compositions useful in conjunction with the present methodologies can comprise a range of corrosion inhibitors and/or surfactant components, together with other components known in the art, to achieve a desired cleaning activity, depending on the type of substrate or build-up to be removed and/or the given end-use application.

Example 1B

A wide range of formulations can be prepared in accordance with this invention. The order of addition and the range of use levels can be but is not limited to that presented below in Table 2. Precaution should be taken when handling the raw materials in each case. After addition of each component into solution, thorough mixing is effected, ensuring that all solid materials are dissolved.

TABLE 2

| Raw Material/Component | Order of Addition | Range of Use |
|---|---|---|
| Methanesulfonic acid (70%) (MSA) | 1 | Quantity Sufficient |
| Urea | 2 | About 0.5-about 5.0 mole ratio of MSA |
| Acid Inhibitor | 3 | About 0.05-about 0.3% (w/w) |

A useful urea methylsulfonic cleaning composition can comprise the composition presented in Table 3.

TABLE 3

Useful System of the Present Invention

| Raw Material/Component | Order of Addition | Use Level |
|---|---|---|
| Methanesulfonic acid (70%) | 1 | 64.2% |
| Urea | 2 | 35.7% |
| Acid Inhibitor | 3 | 0.1% |

The urea is added into the MSA which is a 70% solution in water. Once all of the urea is dissolved, the acid inhibitor is added with mixing. The acid inhibitor that was used is available under the Armohib® 31 trademark, an amine based acid inhibitor.

Note that other higher alkylated (e.g., $C_2$ to about $C_{10}$ ) sulfonic acids may also be used in the same way as MSA in substantially similar concentration/weight ratio as those present in Tables 2 and 3, whether or not commercially available. In addition, as described elsewhere herein, salt formation need not be limited to reaction of alkylsulfonic acid and urea, but may also include other weak bases such as biuret (urea dimer), alkyl urea derivatives and polymeric components with weak base functionality. Other acid inhibitors for use in compositions for cleaning steel, aluminum, brass and/or copper may also be used.

Example 2

Transportation Cleaning

There are a number of applications where significant advantage may be gained both from the personal safety and metal safe characteristics of the invention. These include transportation cleaners for the washing of trucks and cars using touchless wash systems. Removal of road film is a critical function in effective vehicle washing. Road film is a complex matrix that forms from the deposition of airborne materials that include dust (includes silicious materials), carbonaceous (both organic and inorganic) materials and minerals from acid rain. Acids are frequently employed in an attempt to alter the matrix and simplify cleaning and rinsing. The problem that needs to be managed carefully involves "acid burning" of metal parts such as aluminum rims and chrome. In order to avoid this, the prior art typically uses lower concentrations of acid which ensures metal protection but also negatively impacts cleaning efficacy.

For purpose of comparison, formulae for compositions used in the art (control) and representative of one or more embodiments of this invention are shown in Table 4:

TABLE 4

Formulae Tested for Vehicle Cleaning Performance

| Control | Invention |
|---|---|
| 20% Phosphoric acid (85%) | 25% MSA (70%) |
| 3.0% WinSurf Q3 | 3.0% WinSurf Q3 |
| QS (quantity sufficient for 100%) water | 15% Urea |
| | 0.03% Armohib 31 |
| Apply at 100:1 | QS Water |

Application of an inventive composition at a level of 10:1 did not result in any damage to the vehicle and substantially improved road film removal in all vehicles tested. (WinSurf Q3 is the tradename of a nonionic surfactant with excellent wetting properties, available from Win Chemicals Ltd. and Vitech International, Inc.).

Example 3

Tub and Tile Cleaning

Compositions of the present invention were used in a tub and tile based cleaning application. Many tub and tile cleaners in the art are alkaline based products that are effective at soap scum removal but completely ineffective at scale removal. In order to assess the performance in a fair manner, it was decided to compare against an acid-based control. Since urea hydrochloride is both a mild acid product and highly effective at calcium scale removal, a formula consistent with many industrial and retail based products was used as a control. The criteria for evaluation were soap scum removal, calcium and rust scale removal and corrosion of metal fixtures. The formulae tested are shown in Table 5:

TABLE 5

Formulae Tested for Tub and Tile Cleaning Performance

| Control | Invention |
|---|---|
| 10.2% Hydrochloric acid (37%) | 8% MSA (70%) |
| 3.0% WinSurf Q3 | 3.0% WinSurf Q3 |
| 5.8% Urea | 4.5% Urea |
| 0.0125% Armohib 31 | 0.0125% Armohib 31 |
| QS Water | QS Water |

Table 6 summarizes the performance characteristics of the two formulae.

TABLE 6

Performance Summary for Tub and Tile Testing

| Formula | Soap Scum | Calcium Scale | Rust Removal | Fixt. Corrosion 1 | Fixt. Corrosion 2 |
|---|---|---|---|---|---|
| Control Based | Very good | Excellent | Excellent | None | Heavy staining |
| Invention Based | Excellent | Excellent | Excellent | None | None |

Fixt. Corrosion 1 was a 5 minute exposure and wipe of a stainless steel tap fixture. Fixt. Corrosion 2 was a 90 minute exposure and wipe of a stainless steel tap fixture.

The data show that compositions of this invention provide significant improvement in terms of metal corrosion. Even though manufacturers will typically state that a maximum 5 minute exposure is required when using such a product, a 90 minute exposure more practically represents a time over which a consumer forgets that a composition has been applied. In the art, there is then a resulting need to apply metal polish in order to remove staining of the fixture—a problem avoided by the present invention.

Example 4

The following compositions can be prepared for use, as indicated. Percentages are, as elsewhere herein, by weight, and these and various other additives and components can be added or varied for a particular formulation or end-use application. Variation in water quantity can be used to vary weight percent of any one component over ranges of the sort provided herein. Likewise, amounts of acid/base can be varied, without limitation to provide molar ratios of the sort described herein.

Example 4a

Wheel Cleaner
20% MSA (70%)
12% Urea
2.75% WinSurf Q3
0.04% Armohib 31
QS Water
Use as is Example 4b Fallout Remover
25% MSA (70%)
14% Urea
2.75% WinSurf Q3
0.05% Armohib 31
QS Water
Use as is Example 4c CLR Calcium Lime Rust Remover
8.0% MSA (70%)
4.5% Urea
0.25% WinSurf Q3
0.0125% Armohib 31
QS Water
Use as is Example 4d Car Wash Bay Cleaner
25% MSA (70%)
14% Urea
2.75% WinSurf Q3
0.04% Armohib 31
QS Water
Use at about 20-60:1 dilution rate Example 4e Industrial Aluminum Cooling Tower Descaler
30% MSA (70%)
16.5% Urea
0.05% Armohib 31
QS Water
Use as required depending upon thickness of scale Examples 5

The formulation of Example 1, Table 3, has been found to be generally useful for a variety of purposes. Given a three component aqueous solution, with weight ratios of MSA:urea:Armohib 31 equal to 420:330:1, which corresponds to weight ratios of 70% MSA:urea:Armohib 31 of 600:330:1, various concentrations lend themselves to the following applications:

| Total non-aqueous weight percent | Application |
|---|---|
| 0.929 | carpet rinse |
| 1.878 | laundry sour |
| 43.8 | non-hazardous concrete etcher |
| 50.1 | ice machine deicer |
| 77.1 | automatic dishwasher descaler |

Example 6

Addition of a nonionic surfactant to the three components of Example 5 provides even more flexibility for formulations of the invention:

| Total non-aq. weight percent | Weight Ratio* | Application |
|---|---|---|
| 5.51 | 420:330:1:71 | coffee machine descaler |
| 13.0 | 420:330:1:231 | brick/efflorescence descaler |
| 15.5 | 420:330:1:176 | boat hull cleaner |
| 23.5 | 420:330:1:33 | bowl cleaner |
| 26.0 | 420:330:1:30 | beerstone/milkstone descaler |
| 26.5 | 420:330:1:45 | jewelry tarnish remover |

*MSA:urea:Armohib 31:nonionic surfactant

I claim:

1. A method for removing surface contaminants, said method comprising:

providing a composition comprising at least one of a corrosion inhibitor and a surfactant, and the acid-base reaction product of an alkanesulfonic acid component and an organic nitrogenous base component, said base component selected from urea and methylurea, said base component and said acid component in a molar ratio of about 0.5 to about 5.0; and contacting said composition and a surface comprising at least one contaminant.

2. The method of claim 1 wherein said alkanesulfonic acid component is methanesulfonic acid.

3. The method of claim 1 wherein said organic nitrogenous base component is urea.

4. The method of claim 1 wherein said composition comprises a corrosion inhibitor component.

5. The method of claim 1 wherein said composition comprises a nonionic surfactant.

6. The method of claim 1 wherein said surface comprises at least one metal.

7. The method of claim 6 wherein said surface comprises a metal selected from aluminum, iron and copper.

8. The method of claim 1 wherein said surface comprises a metal alloy selected from a steel and a brass.

9. The method of claim 1 wherein said surface is selected from commercial and household surfaces.

10. A method for cleaning a hard surface, said method comprising:

providing at least one of a surfactant and a corrosion inhibitor component, at least one alkanesulfonic acid component and at least one organic nitrogenous base component, said base component selected from urea, methylurea and a combination thereof;

mixing said alkanesulfonic acid component and a said organic nitrogenous base component to provide an acid-base reaction product of said components, together with at least one of said surfactant and corrosion inhibitor components, said base component and said acid component in a molar ratio of about 0.5 to about 5.0, to provide a cleaning composition; and contacting said composition and a hard surface.

11. The method of claim 10 wherein said alkanesulfonic acid is methanesulfonic acid.

12. The method of claim 11 wherein said organic nitrogenous base is urea.

13. The method of claim 10 wherein said surface is selected from commercial and household surfaces, said surfaces comprising contaminants selected from scale, carbonates, rust and combinations thereof.

14. A method of using methanesulfonic acid to affect accumulation of surface contaminants, said method comprising:

providing a substrate comprising a surface contaminant;

providing a composition comprising methanesulfonic acid, urea and at least one of a surfactant and a corrosion inhibitor component, said urea and said methanesulfonic acid in a molar ratio of about 0.5 to about 3.0; and contacting said substrate surface and said composition, said contact at least partially sufficient to at least partially remove at least one of said contaminants from said surface.

15. The method of claim 14 wherein said surface is selected from hard commercial and household surfaces.

16. The method of claim 14 wherein said contaminant is selected from metal salts, aluminum scale, road film, rust, lime, siliceous materials, proteinaceous materials and combinations thereof.

17. The method of claim 14 wherein said contact is substantially absent surface corrosion.

18. The method of claim 14 wherein said composition is non-corrosive to human tissue.

* * * * *